US007476068B2

(12) United States Patent
Lau

(10) Patent No.: US 7,476,068 B2
(45) Date of Patent: Jan. 13, 2009

(54) CARGO SHIPPING ASSEMBLY AND METHOD

(75) Inventor: Vincent W. S. Lau, Sai Kung (HK)

(73) Assignee: Sun Pleasure Company, Ltd., Hong Kong (HK)

( * ) Notice: Subject to any disclaimer, the term of this patent is extended or adjusted under 35 U.S.C. 154(b) by 633 days.

(21) Appl. No.: 11/054,452

(22) Filed: Feb. 9, 2005

(65) Prior Publication Data

US 2006/0175227 A1 Aug. 10, 2006

(51) Int. Cl.
*B60P 7/08* (2006.01)

(52) U.S. Cl. ..... 410/98; 410/46; 410/97; 410/99; 410/120; 410/155; 206/386

(58) Field of Classification Search ..... 410/46, 410/96, 97, 98, 99, 120, 155; 206/386, 453, 206/586; 108/55.1; 53/172
See application file for complete search history.

(56) References Cited

U.S. PATENT DOCUMENTS 2,277,674 A * 3/1942 Belsinger
4,887,946 A * 12/1989 Sevier ..... 410/32

* cited by examiner

*Primary Examiner*—Stephen Gordon
(74) *Attorney, Agent, or Firm*—Raymond Sun

(57) ABSTRACT

A method of loading cargo includes the steps of providing a lower frame, supporting the cargo on the lower frame, positioning a plurality of vertical posts in spaced apart manner about the lower frame and exterior to the cargo, supporting an upper frame above the posts, and securing the lower frame, the posts and the upper frame around the cargo.

11 Claims, 2 Drawing Sheets

61
60
62
63
50
52
53
51
54
55
56
84
80
40
82
86
33
32
34
31
30
24
23
21
70
20
22
25

10

CARGO SHIPPING ASSEMBLY AND METHOD

BACKGROUND OF THE INVENTION

1. Field of the Invention

The present invention relates to cargo shipping assemblies that save storage space in containers, and which minimize the cost of labor, while effectively protecting the cargo stored therein.

2. Description of the Related Art

The shipping of cargo has becoming increasingly important in today's business environment. Shipping is usually carried out by truck, air or sea. The cargo is typically loaded on to pallets, which can be stored in containers for shipping. Alternatively, the cargo can be loaded loosely (without a pallet) into a container for shipping.

Unfortunately, both pallet-loading and loose-loading of cargo suffer from drawbacks. Pallets take up a lot of space in a container. On the other hand, loose-loading is very labor-intensive because laborers will be needed to slowly load the cargo into a container at the embarkation point, and to slowly unload the cargo from the container at the destination.

SUMMARY OF THE INVENTION

It is an objective of the present invention to provide a cargo shipping assembly that saves storage space in containers.

It is another objective of the present invention to provide a cargo shipping assembly which minimizes the cost of labor.

The objectives of the present invention can be accomplished by providing a method of loading cargo, which includes providing a lower frame, supporting the cargo on the lower frame, positioning a plurality of vertical posts in spaced apart manner about the lower frame and exterior to the cargo, supporting an upper frame above the posts, and securing the lower frame, the posts and the upper frame around the cargo.

The cargo assembly of the present invention includes a lower frame, cargo supported on the lower frame, a plurality of vertical posts positioned in spaced apart manner about the lower frame and exterior to the cargo, and an upper frame supported above the posts. The lower frame, the posts and the upper frame are secured around the cargo, and can be provided in separate pieces.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
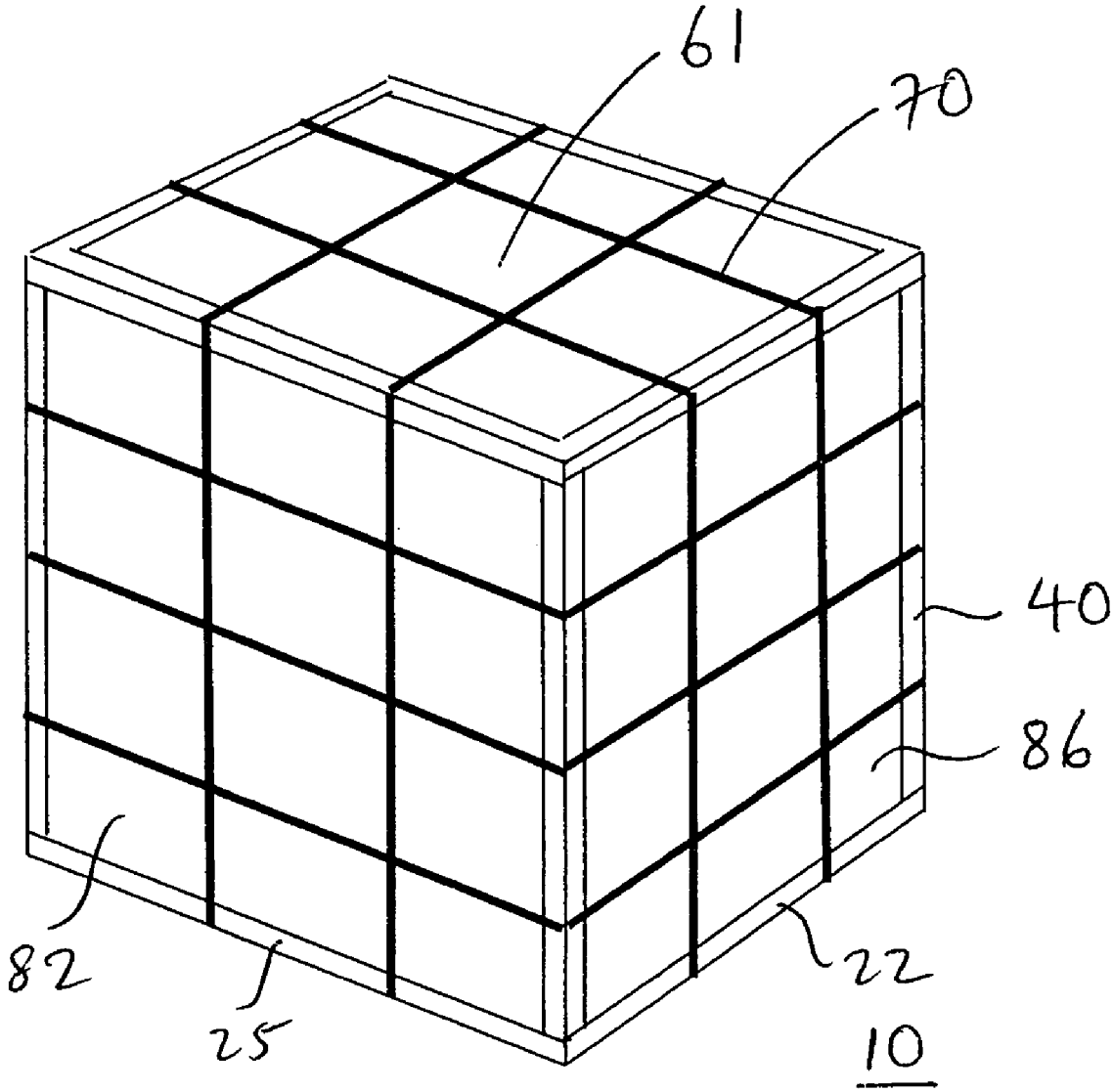
FIG. 1 is an perspective view of a cargo shipping assembly according to one embodiment of the present invention.
Figure 2:
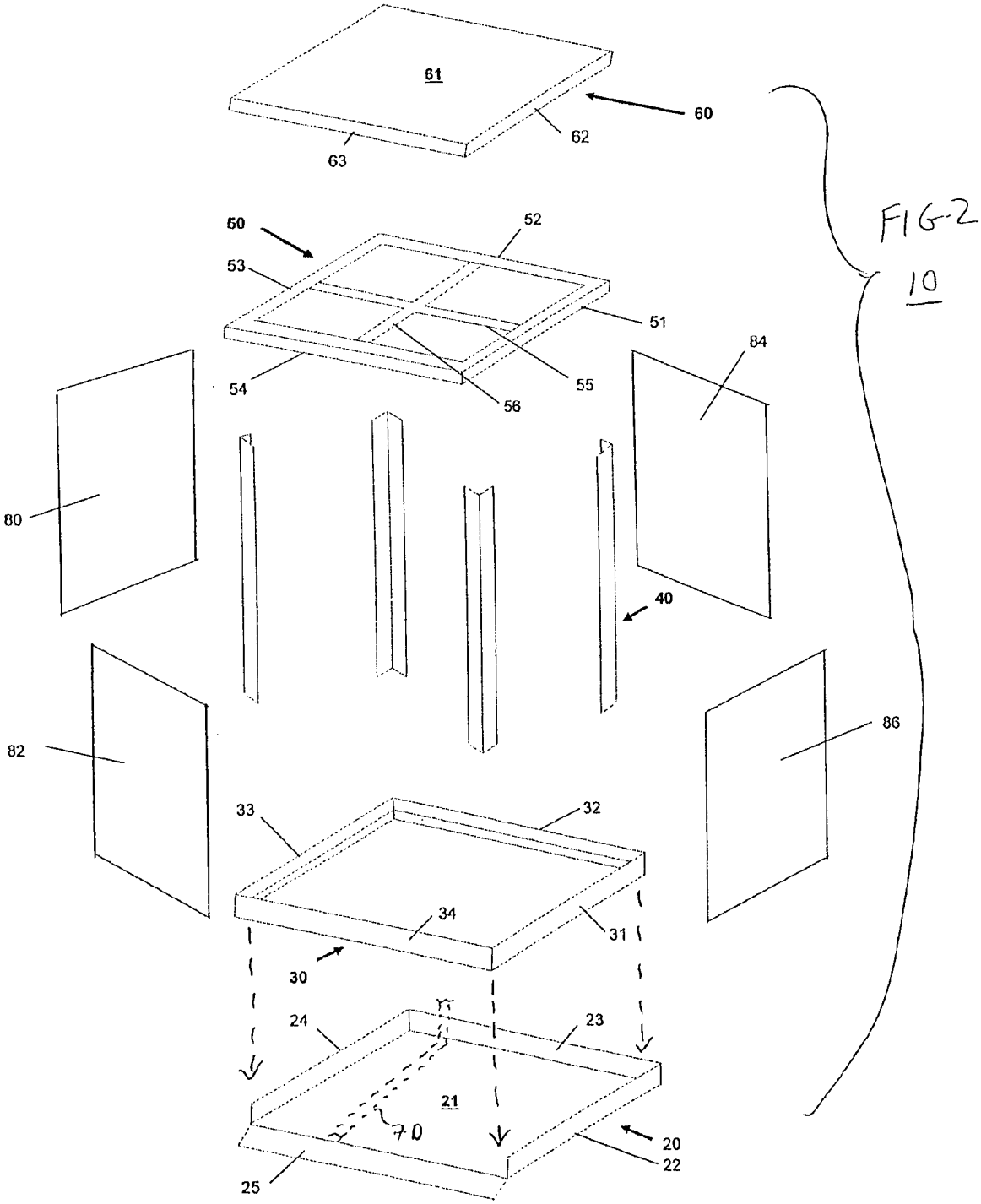
FIG. 2 is an exploded perspective view of the cargo shipping assembly of FIG. 1.

Referring to FIGS. 1 and 2, the cargo shipping assembly 10 of the present invention has a bottom flat board 20, a lower frame 30, four vertical support posts 40, an upper frame 50, and a top flat board 60.

The bottom flat board 20 has a planar sheet 21 of material with four border edges 22, 23, 24 and 25 provided along each edge of the planar sheet 21. The bottom flat board 20 can be made from paper board, cardboard, plastic sheets, metal sheets, wood board or similar materials.

The lower frame 30 has four bars 31, 32, 33 and 34 that are connected together to form a four-sided (rectangular or square) frame that defines a periphery, with each bar 31, 32, 33, 34 corresponding to one of the border edges 22, 23, 24, 25. The lower frame 30 can be made from metal, wood, paper board, cardboard, plastic or any similar strong material. The lower frame 30 is placed on the planar sheet 21, with the border edges 22, 23, 24, 25 of the bottom flat board 20 extending around the bars 31, 32, 33, 34, respectively. The lower frame 30 can then be secured within the bottom flat board 20 by strapping bands or sealing tapes (e.g., see 70 in FIG. 1) that are wrapped around the assembly 10 after the entire assembly 10 has been put together, as shown in FIG. 1.

The top flat board 60 is similar to the bottom flat board 20, and the upper frame 50 is similar to the lower frame 30, and interact in the same manner. The top flat board 60 has a planar sheet 61 of material with four border edges (only two edges 62, 63 are shown) provided along each edge of the planar sheet 61. The top flat board 60 can be made from paper board, cardboard, plastic sheets, metal sheets, woodboard or similar materials.

The upper frame 50 has four border bars 51, 52, 53, 54 that are connected together to form a four-sided (rectangular or square) frame that defines a periphery, with each border bar 51, 52, 53, 54 corresponding to one of the border edges 62, 63 of the top flat board 60. In addition, two crossing bars 55 and 56 extend within the interior space defined by the four border bars 51, 52, 53, 54, with the crossing bar 55 having ends connected to the border bars 51 and 53, and the crossing bar 56 having ends connected to the border bars 52 and 54. The bars 51-56 of the upper frame 50 can be made from metal, wood, paper board, cardboard, plastic or any similar strong material, and function to reinforce and maintain the upper frame 50 in its proper shape to support loads that may be exerted from other assemblies 10 that may be stacked on top of this assembly 10. The planar sheet 61 is positioned over the upper frame 50, with the border edges (e.g., 62, 63) of the top flat board 60 extending around the bars 51, 52, 53, 54. The upper frame 50 can then be secured within the top flat board 60 by strapping bands or sealing tapes (e.g., see 70 in FIG. 1) that are wrapped around the assembly 10 after the entire assembly 10 has been put together, as shown in FIG. 1.

Each of the four vertical support posts 40 has opposing ends that are fitted to opposing corners of the upper frame 50 and the lower frame 30. Each support post 40 can be made from any strong yet lightweight material, such as but not limited to metal or plastic. Each support post 40 can have any desired cross-sectional configuration, including L-shaped (as shown), square, triangular, rounded, etc.

Four side walls 80, 82, 84, 86 are provided to enclosed the sides of the assembly 10. Each side wall 80, 82, 84, 86 is fitted inside and between two adjacent posts 40, and between a bar of the upper frame 50 and a bar of the lower frame 30. For example, the side wall 86 is fitted inside and between two posts 40, and between the bars 51 and 31 of the frames 50 and 30, respectively.

The assembly 10 can be assembled, and the cargo loaded, in the following manner. First, the bottom flat board 20 is placed on the ground, and one or more strapping bands 70 are placed below of the planar sheet 21. The bars 31, 32, 33, 34 of the lower frame 30 are then placed on the sides of the planar sheet 21, with the border edges 22, 23, 24, 25 surrounding the corresponding bars 31, 32, 33, 34, and then the cargo (e.g., products or boxes) is placed on top of the planar sheet 21 and stacked to a desired height. A protective sheet (e.g., such as a stretched film) can be used to wrap the exterior of the stacked cargo so as to protect the cargo from scraping with the side walls 80, 82, 84, 86 during shipment. The side walls 80, 82, 84, 86 are then placed around the four sides of the stacked cargo, and then the four posts 40 are positioned around the four corners of the stacked cargo, with each post 40 securing an edge of two adjacent side walls 80, 82, 84, 86. In addition, the bottom end of each post 40 is inserted into a corner defined by two adjacent bars (e.g., 31 and 32) of the lower frame 30. Then, the upper frame 50 is placed over the stacked cargo, with the top end of each post 40 inserted into a corner defined by two adjacent bars (e.g., 51 and 52) of the upper frame 50. The top flat board 60 is now placed on top of the upper frame 50, with the border edges (e.g., 62, 63) surrounding the corresponding bars 51, 52, 53, 54. The entire assembly 10 is then secured by strapping bands or sealing tapes (e.g., see 70 in FIG. 1) that are wrapped around the completed assembly 10, as shown in FIG. 1.

The assembly 10 can be disassembled, and the cargo unloaded, in the following manner. First, the strapping bands 70 are cut, and then the top flat board 60, the upper frame 50, the posts 40, and the side walls 80, 82, 84, 86 are removed (in this order). The protective sheet (if any) is then removed, and then the cargo can be unloaded. Depending on the nature of the cargo (and if necessary), the lower frame 30 can also be removed (and the corners between the border edges 22, 23, 24, 25 can be cut), to facilitate convenient removal of the cargo.

During the loading of the cargo, all the components of the assembly 10 (i.e., the bottom flat board 20, the lower frame 30, the vertical support posts 40, the upper frame 50, the top flat board 60, and the side walls 80, 82, 84, 86) are fitted together without the need for them to be positively attached or otherwise connected to each other. The application of strapping bands or sealing tapes (e.g., see 70 in FIG. 1) that are wrapped around the completed assembly 10 is sufficient to secure the loaded cargo inside the assembly 10. This feature enables the cargo to be loaded (i.e., the assembly 10 put together) or unloaded (i.e., the assembly 10 to be taken apart) quickly and conveniently, thereby minimizing labor and shipping costs.

The bottom flat board 20, the lower frame 30, the four vertical support posts 40, the upper frame 50, and the top flat board 60 together function to contain and protect the cargo loaded inside. In addition, the upper frame 50 functions to divide the force from the upper load (from another assembly 10 placed on top of the top flat board 60) evenly to its four corners, so that each corner picks up a divided share (in this case, one-fourth) of the entire upper load force, and then transfers this force to the support post 40. Each support post 40 picks up a divided share (in this case, one-fourth) of the entire upper load force, and then transfers this force to the corresponding corner of the lower frame 30, which subsequently transfers this force (via the bottom flat board 20) to the floor or another assembly 10 positioned below.

While the description above refers to particular embodiments of the present invention, it will be understood that many modifications may be made without departing from the spirit thereof.

What is claimed is:

1. A method of loading cargo, comprising:

a. providing a lower frame;

b. supporting the cargo on the lower frame;

c. positioning a plurality of vertical posts in spaced apart manner about the lower frame and exterior to the cargo;

d. supporting an upper frame above the posts, the upper frame having a plurality of bars that define a periphery, and a pair of crossing bars that extend from the periphery and which intersect at about the center of the upper frame; and e. securing the lower frame, the posts and the upper frame around the cargo.

2. The method of claim 1, wherein the lower frame, the posts and the upper frame are provided in separate pieces.

3. The method of claim 1, wherein step (a) includes:

a1. providing a bottom board; and a2. positioning the lower frame on the bottom board.

4. The method of claim 3, wherein the lower frame comprises a plurality of bars that define a periphery, and wherein step (a) further includes:

providing the bottom board with at least one border edge; and positioning the at least one border edge external to one of the lower frame plurality.

5. The method of claim 1, wherein step (d) further includes:

positioning a top board above the upper frame.

6. The method of claim 5, wherein step (d) further includes:

providing the top board with at least one border edge; and positioning the at least one border edge external to one of the plurality of bars.

7. The method of claim 1, wherein step (c) further includes:

positioning bottom ends of the plurality of vertical posts in spaced apart manner about the lower frame.

8. The method of claim 7, wherein step (d) further includes:

positioning top ends of the plurality of vertical posts in spaced apart manner about the upper frame.

9. The method of claim 1, wherein step (d) further includes:

positioning top ends of the plurality of vertical posts in spaced apart manner about the upper frame.

10. The method of claim 1, further including:

positioning at least one side wall external to the cargo and between two adjacent posts of the plurality of vertical posts.

11. The method of claim 1, further including:

placing another cargo on top of the upper frame, the another cargo exerting a force;

dividing the force of the another cargo; and transferring the divided forces to the lower frame.

* * * * *